United States Patent [19]

Schwab

[11] 4,021,359

[45] May 3, 1977

[54] DETERGENT BUILDERS FOR WASHING AND CLEANING COMPOSITIONS

[75] Inventor: Frederick C. Schwab, Metuchen, N.J.

[73] Assignee: Mobil Oil Corporation, New York, N.Y.

[22] Filed: Oct. 11, 1973

[21] Appl. No.: 405,387

[52] U.S. Cl. ..... 252/89 R; 260/485 G; 252/108; 252/175; 252/539; 536/119

[51] Int. Cl.[2] ..... C11D 3/20; C11D 7/26; C11D 9/26

[58] Field of Search ..... 260/485 G; 252/89 R

[56] References Cited

UNITED STATES PATENTS

| | | | |
|---|---|---|---|
| 2,353,696 | 7/1944 | De Groote et al. | 260/485 G |
| 3,099,683 | 7/1963 | Trombs | 260/485 G |
| 3,141,012 | 7/1964 | O'Boyle | 260/485 G |
| 3,280,067 | 10/1966 | Anagnostopoulos | 260/485 G |
| 3,305,568 | 2/1967 | Klemchuk | 260/485 G |
| 3,322,817 | 5/1967 | Goldberg | 260/485 G |
| 3,655,645 | 4/1972 | Jacques | 260/485 G |
| 3,892,674 | 7/1975 | Kandler et al. | 260/485 G |

*Primary Examiner*—Jane S. Myers
*Attorney, Agent, or Firm*—Charles A. Huggett; Hastings S. Trigg

[57] ABSTRACT

Novel compounds comprising water-soluble salts of partial esters of maleic anhydride and polyhydric alcohols containing at least three hydroxy groups sequester and retard the precipitation of $Ca^{++}$ ions, and function as detergent builders for washing and cleaning compositions in aqueous solutions thereof.

3 Claims, No Drawings

DETERGENT BUILDERS FOR WASHING AND CLEANING COMPOSITIONS

BACKGROUND OF THE INVENTION

1. Field of the Invention

This application relates to detergent compositions containing as detergent builders novel compounds which are water-soluble salts of partial esters of maleic anhydride and a polyhydric alcohol.

2. Description of the Prior Art

Today the major components of detergent compositions generally comprise detergent-active compounds and detergency builders. The use of builders is generally considered necesary to improve detergency levels of such compositions. Although, it is not known with any degree of certainty how the builders function in the detergent systems, it is believed that they affect in varying degrees such factors as stabilization and/or anti-redeposition of soil suspensions, emulsification of soil particles, surface activity of the aqueous detergent solutions, solubilization of water in soluble materials, foam or suds producing characteristics of the washing solutions, peptization or deflocculation of soil agglomerates, neutralization and/or buffering of acid or basic soils, sequestering of metallic ions, etc.

In the prior art the most frequently used detergent builders were condensed phosphates, particularly sodium tripolyphosphate, sodium nitrilotriacetate and sodium copolyethylene-maleate. These and similar phosphorus and nitrogen containing compounds also used as builders are thought by many environmentalists to be a major cause of the eutrophication of various natural bodies of water. In other words, it is generally believed that presently acceptable nitrogen and/or phosphorus containing detergent builders significantly contribute to water pollution by providing eutrophication conditions therein which are favorable to the growth of algae and other undesirable aquatic plants and bacteria; rendering said water unfit for human use or desirable aquatic life. Thus there is a need and a desire to reduce or replace existing phosphate and/or nitrogen detergent builders in detergent compositions.

A suitable detergent builder should therefore be biodegradable, should contain minimal amounts of or no elements which cannot be converted into carbon dioxide and water, should be compatible with presently existing detergent materials and additives thereto, such as bleaching agents and the like and should not adversely affect the material to be washed or cleaned.

The detergent builders of this invention permit the aforementioned desirable reduction or replacement of phosphate and/or nitrogen containing builders in detergent compositions and also provide a biodegradable builder for such compositions.

SUMMARY OF THE INVENTION

This invention, therefore, provides a phosphorus and nitrogen-free biodegradable, organic detergent builder which is compatible with a wide range of detergents and soaps which are suitable for use in both washing and cleaning compositions. This invention also provides a detergent builder with properties comparable to presently used commercial builders.

The novel compounds according to this invention are water-soluble salts of partial esters of maleic anhydride and aliphatic polyhydric alcohols having preferably at least three hydroxy groups and more preferably such alcohols should have from about 3 to 20 carbon atoms. The compounds are usually recovered and utilized as the alkali metal or ammonium salt of the reaction product which is a partial ester of the anhydride and the polyhydric alcohol. The polyhydric alcohol is preferably selected from the following non-limiting group of saturated polyhydric alcohols, consisting of glycerol, erythritol, pentaerythritol, dipentaerythritol, tripentaerythritol, sorbitol, sucrose, mannitol, arabitol and the like.

The compounds embodied herein are especially useful in detergent compositions containing at least one detergent-active compound. In such detergent compositions, the detergent-active compound may be present in an amount ranging from about 5 to about 50% and preferbly from about 5 to about 35% by weight of the total composition and the detergent builder may be present in a weight ratio of detergent builder to detergent-active compound within the range of about 10:1 to about 1:10.

Detergent-active compounds conventionally incorporated in or proposed for use on detergent compositions may be used, and those skilled in the art of formulating detergent compositions will be familiar with these detergent-active compounds and the various amounts and combinations in which they may advantageously be used. The detergent-active compound or compounds may be anionic, nonionic, amphoteric or zwitterionic in character.

Anionic detergent-active compounds include both soap and non-soap type compounds. Examples of suitable soaps are the sodium, potassium, ammonium and alkylolammonium salts of higher fatty acids ($C_{10}$–$C_{20}$). Particularly useful are the sodium or potassium salts of the mixtures of fatty acids derived from coconut oil and tallow, i.e., sodium or potassium tallow and coconut soap and tall oil. Examples of anionic organic non-soap detergent compounds are the water soluble salts, alkali metal salts of organic sulfuric reaction products having in their molecular structure an alkyl radical containing from about 8 to about 22 carbon atoms and a radical selected from the group consisting of sulfonic acid and sulfuric acid ester radicals. (Included in the term alkyl is the alkyl portion of higher acyl radicals.) Examples of suitable anionic synthetic detergent-active compounds are the sodium or potassium alkyl sulfates especially those obtained by sulfating the higher alcohols ($C_8$–$C_{18}$ carbon atoms) produced by reducing the glycerides of tallow or coconut oil; sodium or potassium alkyl benzene-sulfonates in which the alkyl group contains from about 9 to about 20 carbon atoms and in which the benzene ring is attached to the alkyl chain at either the one position or at the secondary positions such as in sodium linear alkyl ($C_{10}$–$C_{15}$) secondary benzene sulfonate, sodium p-(2-dodecyl) benzene sulfonate, sodium p-(2-octadecyl) benzene sulfonate, sodium p-(3-dodecyl) benzene sulfonate and 3-phenyldodecanesulfonate; sodium alkyl glyceryl ether sulfonates, especially those ethers of the higher alcohols derived from tallow or coconut oil and synthetic alcohols derived from petroleum.

Examples of suitable nonionic detergent-active compounds are: condensates of alkyl-phenols having an alkyl group (derived, for example, from polymerized propylene, diisobutylene, octene, dodecene or nonene) containing from about 6 to 12 carbon atoms in either a straight chain or branched chain configuration, with about 5 to 25 moles of ethylene oxide per mole of alkyl-phenol; condensates containing from about 40% to about 80% polyoxyethylene by weight and having a molecular weight of from about 5,000 to about 11,000 resulting from the reaction of ethylene oxide with the reaction product of ethylenediamine and excess propylene oxide; condensates of linear or branched-chain aliphatic alcohols containing from 8 to 18 carbon atoms with ethylene oxide, e.g., a coconut alcohol-ethylene oxide condensate containing about 6 to 30 moles of ethylene oxide per mole of coconut alcohol; long-chain tertiary amine oxides corresponding to the general formula $R_1R_2R_3N \rightarrow O$, wherein $R_1$ is an alkyl radical containing from about 8 to 18 carbon atoms and $R_2$ and $R_3$ are each methyl, ethyl or hydroxy ethyl radicals, such as dimethyldodecylamine oxide, dimethyloctylamine oxide, dimethylhexadecylamine oxide and N-bis (hydroxyethyl) dodecylamine oxide; long chain tertiary phosphine oxides corresponding to the general formula $RR'R''P \rightarrow O$ wherein R is an alkyl, alkenyl or monohydroxyalkyl radical containing from 10 to 18 carbon atoms and R' and R'' are each alkyl or monohydroxyalkyl groups containing from 1 to 3 carbon atoms, such as dimethyldodecylphosphine oxide, dimethyltetradecylphosphine oxide, ethylmethyltetradecylphosphine oxide, dimethylstearylphosphine oxide, ethylpropylcetylphosphine oxide, diethyldodecylphosphine oxide, bis(hydroxymethyl) dodecylphosphine oxide, bis (2-hydroxyethyl) dodecylphosphine oxide, 2-hydroxypropylmethyltetradecylphosphine oxide, dimethyloleylphosphine oxide and dimethyl-2-hydroxydodecylphosphine oxide; and dialyl sulphoxides corresponding to general formula $RR'S \rightarrow O$, wherein R is an alkyl, alkenyl, beta- or gamma-monohydroxyalkyl radical or an alkyl or beta- or gamma-monohydroxyalkyl radical containing one or two other oxygen atoms in the chain, the R groups containing from 10 to 18 carbon atoms and wherein R' is methyl, ethyl or alkylol radical, such as dodecyl methyl sulphoxide, tetradecyl methyl sulphoxide, 3-hydroxytridecyl methyl sulphoxide, 2-hydroxydodecyl methyl sulphoxide, 3-hydroxy-4-dodecyloxybutyl methyl sulphoxide, 2-hydroxy-3-decylopropyl methyl sulphoxide, dodecyl ethyl sulphoxide, 2-hydroxydodecyl ethyl sulphoxide and dodecyl-2-hydroxyethyl sulphoxide.

Examples of suitable amphoteric detergent-active compounds are: derivatives of aliphatic secondary and tertiary amines, in which the aliphatic radical may be straight chain or branched and wherein one of the aliphatic substituents contain from about 8 to 18 carbon atoms and one contains an an anionic water-solubilizing group, such as sodium-3-dodecylaminopropionate, sodium-3-dodecylaminopropanesulphonate and sodium N-2-hydroxydodecyl-N-methyl-taurate.

Examples of suitable zwitterionic detergent-active compounds are: derivatives of aliphatic quaternary ammonium compounds, sulphonium compounds and phosphonium compounds in which the aliphatic radical may be straight chain or branched and wherein one of the aliphatic substituents contains from about 8 to 18 carbon atoms and one contains an anionic water solubilizing group, such as 3-(N,N-dimethyl-N-hexadecylammonium) propane-1-sulphonate betaine, 3-(N,N-dimethyl-N-hexadecyl-ammonium)-2-hydroxypropane-1-sulphonate betaine, 3-(dodecylmethyl-sulphonium) propane-1-sulphonate betaine, and 3-(cetylmethylphosphonium) ethane sulphonate betaine.

Further examples of suitable detergent-active compounds commonly used in the art are given in "Surface Active Agents, volume I" by Schwartz and Perry (Interscience 1949) and "Surface Active Agents, volume II" by Schwartz, Perry and Berch (Interscience 1958), the disclosures of which are included by reference herein.

Additionally, the detergent compositions according to this invention may contain ingredients other than the detergent builder and detergent-active compound. Examples of such other constituents are perfumes, colorants, fabric softening agents, fungicides, germicides, anti-redeposition agents, hydrotropes, bleaches, organic solvents, etc.

Detergent compositions containing the novel detergent builders accordng to this invention may be prepared by any conventional manufacturing technique in any of the common physical forms for detergent compositions, such as powders, flakes, granules, noodles, cakes, bars, and liquids.

The novel detergent builder embodied herein may be synthesized by reaction, under esterification conditions, of maleic anhydride and a polyhydric alcohol such as described above. A suitable method includes heating a mixture of maleic anhydride and such polyhydric alcohol in appropriate amounts to an elevated temperature which is sufficient to maintain said mixture in liquid phase for a period of time sufficient to carry out the sterification. Suitable temperatures for such a reaction includes a range from about 100° to about 200° C, depending in particular upon the polyhydric alcohol used; reaction time may vary from a period of about 10 to about 60 minutes depending upon the particular reactants.

Following the desired esterification reaction, it is desirable to remove unreacted maleic anhydride (e.g., via vacuum distillation), and after such removal convert the resulting partial ester of the maleic anhydride and the polyhydric alcohol to water-soluble salts. This may be accomplished, for example, by treating an aqueous dispersion of the partial ester with an alkali metal or ammonium hydroxide solution to convert the partial ester to the corresponding water-soluble salt.

The reaction to provide the desired partial ester of maleic anhydride and a polyhydric alcohol is generally carried out by reacting the polyhydric alcohol under esterification conditions with at least a stoichiometric amount of maleic anhydride, i.e., at least 1 mole of maleic anhydride per alcoholic group in the polyhydric alcohol. Thus, in example, for production of the desired partial ester of maleic anhydride and pentaerythritol the esterification is carried out by reacting at least 4 moles of maleic anhydride per mole of pentaerythritol. However, preferably an excess of maleic anhydride is used over the stoichiometric amount, preferably an excess of about 10%.

In illustration of such a stoichiometric reaction to provide partial esters of maleic anhydride and a polyhydric alcohol, exemplified by pentaerythritol, the following equation is set forth:

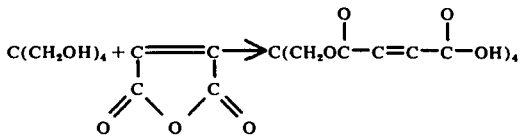

While it is preferable that the esterification reaction be carried out to the extent that all or substantially all of the hydroxyl groups of the polyhydric alcohol are esterified in the compounds for conversion to salts embodied herein for use as detergent-builders, embodied herein are partial esters that contain some free hydroxy groups, by virtue of incomplete esterification of all alcoholic groups of the polyhydric alcohol by the maleic anhydride during the esterification reaction, but which are convertible to water-soluble salts.

The detergent builders according to the invention are recovered by converting the partial esters of maleic anhydride and polyhydric alcohol into water-soluble salts. This is accomplished by reacting the carboxylic groups of said partial esters with salt-forming alkali metal or ammonium compounds.

This invention is illustrated by the following examples in which all parts and percentages are given by weight. These examples are intended to be merely illustrative and in no way limit the scope of this invention.

EXAMPLE 1

A 1,000 ml. resin kettle was charged with 50.0 gms. (0.36 moles) of pentaerythritol and 151.0 gms. (1.54 moles) of maleic anhydride (MA). The temperature was raised to between 150°–173° C., under nitrogen pressure. At this time the mixture was in solution form. The temperature was held at 175° C. for about 15 minutes, after which excess maleic anhydride was distilled off by vacuum distillation. A quantity of about 44.0 gms. of excess maleic anhydride was recovered and a product yield of 151.0 gms. realized. The product was digested in 1,000 ml. of distilled water overnight and titrated to a phenolpthalein endpoint with a 20% NaOH solution. The product did not pass into solution until the sodium hydroxide was added. The sodium salt of the product was recovered as a dry powder, 151.0 gms., after the water was evaporated.

EXAMPLE 2

This Example is identical with Example 1 except that 50.0 gms. of dipentaerythritol (0.19 moles) and 112.0 gms. of maleic anhydride (1.14 moles) were charged to the reactor. The same sequence as outlined in Example 1 above was subsequently followed, also with recovery of the sodium salt as a dry powder.

EXAMPLE 3

This Example is also identical with Example 1 except that 70.0 gms. (0.18 moles) of tripentaerythritol and 148.0 gms. (1.51 moles) of maleic anhydride were used. Ultimate recovery of the sodium salt as a dry powder realized a yield of 211.0 gms.

EXAMPLE 4

This Example is the same as Example 1 except that 50.0 gms. (0.27 moles) of sorbitol and 162.0 gms. (1.65 moles) of maleic anhydride were used. Vacuum distillation gave 99.2 gms. of excess maleic anhydride and 94.0 gms of the sodium salt of the product.

Analytical data on the extent of the reactions and identity of structure is given in Table 1 for Examples 1, 3 and 4. The percent saponification is essentially equivalent to the percent of esterification.

TABLE 1

ANALYTICAL RESULTS ON DETERGENT BUILDERS

| | Reactants | | | | Sodium Salt of Partial Esters | | | |
|---|---|---|---|---|---|---|---|---|
| Example No. | Alcohol | Gms MA Added | Gms MA Recovered | % MA Reacted | I.R. Analysis | Saponification No. Theo. | Actual | % Sap. |
| 1 | Pentaerythritol | 151.0 | 44.0 | 71 | Carboxylate & ester | 336 | 232 | 69 |
| 3 | Tripentaerythritol | 148.0 | 0.0 | 100 | Carboxylate & ester | 364 | 300 | 82 |
| 4 | Sorbitol | 162.0 | 99.0 | 39 | Carboxylate & ester | 371 | 163 | 45 |

The reaction product, i.e., the sodium salt thereof of Example 3, was compared with known detergent builders such as sodium tripolyphosphate (STPP) and sodium nitrilotriacetic acid (NTA) for calcium sequestering by visual observation with regard to the appearance of turbidity under the following test procedure. For such comparison purposes there was used an aqueous solution of 0.15 gms. of the respective builder in 150 ml. of water with an adjusted pH of 10.0. The solutions were then titrated with 0.1 normal calcium nitrate solution, the pH being maintained at 10.0 by adding as needed a sufficient amount of tetramethylammonium hydroxide to the endpoint using calcium electrodes with the addition of the calcium nitrate solution continued until the occurrence of turbidity. The results of such test are set forth in Table II below.

A standardized Tergo-o-tometer laboratory machine washing procedure was utilized on standard soiled fabric specimens to compare a builder as embodied herein to STPP and NTA. The results of the Terg-o-tometer tests are tabulated in Table II. They clearly show that the water-soluble salts according to this invention are effective detergent builders. The Terg-o-tometer test procedure utilized is set forth below.

TABLE II

| Identification of Builder | Calcium Sequestering Test: Orig. pH | Turbidity gm. $Ca^{++}$/100 gm. of builder | Tergotometer Test (Deviation In Reflectance) Units Compared to: Tap $H_2O$ | Std. Detergent Formulation |
|---|---|---|---|---|
| $Na_5P_3O_{10}$(STPP) | 9.5 | 16.1 | +4.0 | 0.0 |
| $N(COONa)_3$(NTA) | 10.55 | >25 | +2.7 | −0.2 |
| Example No. 3 | 7.12 | >25 | +3.2 | −0.9 |

TERGO-O-TOMETER TEST PROCEDURE

Overall Test Procedure

1. The test procedure consists of the following series of operations, which is repeated three times.
   a. soiling cloth swatches,
   b. measuring reflectance of soiled swatches,
   c. washing, rinsing, and drying,
   d. measuring reflectance of washed swatches.

2. In each set of tests a standard detergent formulation (1 gram) is used in one beaker, tap water in a second, and test detergent builders in the other beakers and an equivalent amount of the builder to be tested is substituted for the amount of STPP as disclosed below in the standard detergent formulation. The reflectance readings of the ten swatches used in each beaker are averaged. The effectiveness of the test detergents is determined by a comparison of the averages of the final reflectance with the averages for the standard detergent and tap water.

Standard Detergent

1. The standard detergent consists of 15% linear alkyl benzene sulfonate (LAS), 35% STPP and 50% $Na_2SO_4$. For each washing with standard detergent, 0.177 g of 85% assay sulffamin LX* flakes, 0.350 gms. of STPP, and 1.135 gm of $Na_2SO_4$. 10 $H_2O$ are weighed out.

*LX = tradename.

Standard Hard Water

1. Fill a 5-gallon carboy with cold tap water (hardness = 60 ppm).
2. Add a solution of 1.2 gms. $CaCl_2 \cdot 2\ H_2O$ in 100 cc water.
3. Mix well and measure hardness (90–110 ppm is satisfactory).

Preparation of Terg-o-tometer

1. Fill tank with distilled water to within 3½ inches of top of tank, with one beaker removed.
2. Turn on tank heater and set thermostat to give a temperature of 120° F. About 40 minutes is required to heat from room temperature to 120° F.
3. Adjust agitator speed to 100 rpm.

Soiling Procedure

1. Before soiling, test swatches are coded (indelible ink) to identify each person doing the soiling and to indicate the beaker in which the swatches will be placed. A 1½ inch circle is drawn on each swatch. The soiled spot is to be located in this circle.
2. For each terg-o-tometer beaker to be used, 10 people soil one swatch each. If four beakers are to be used, then each person will soil four swatches, one for each beaker.
3. Soiling is carried out by placing the circle over a rubber stopper (or other suitable object) of about 1½ inches diameter and covered with a layer of sponge rubber. This is then rubbed over different areas of the skin.
4. Resoiling (after each wash) is done by the same 10 persons, each soiling the same swatches as before.

Reflectance Measurements

1. Adjust galvanometer zero (switch A off).
2. Turn switch A on, place search unit on $MgCO_3$ standard, and adjust galvanometer to read 97.5.
3. Read the reflectance for the first set of four swatches (soiled spots). Set search unit back on the $MgCO_3$ block.
4. Repeat No. 3 for each additional set of four swatches.

Washing Procedure

1. At least 10 minutes before washing is to begin, fill beakers A, C, and D with 1 liter of standard hard water, and beaker B with 1 liter of tap water.
2. When water in beakers is up to temperature, add standard detergent sample to A and test detergents to C and D at desired concentrations. Agitate to dissolve approximately 2 minutes.
3. Turn off agitator, add test swatches, and agitate for 10 minutes. Remove swatches and squeeze dry by hand.
4. Empty beakers and refill with one liter of tap water. When water is up to temperature, add cloth swatches and agitate 5 minutes.
5. Remove swatches, squeeze dry by hand, and hang in oven at 70°–80° C. Remove as soon as dry.
6. Beakers and agitators are cleaned well at the end of the test (after three wash cycles).

Various changes and modifications to the above disclosed embodiments may be made without departing from the spirit and scope of this invention without departing from the spirit and scope of this invention and it is thus intended that all matters contained in this description shall be interpreted solely as illustrative and not as limiting.

What is claimed is:

1. A detergent composition consisting essentially of between about 5 percent and about 50 percent, by weight of the total composition, of a detergent-active compound and a detergent builder compound having the formula: $R—(OOC—CH{=}CH—COOM)_n$, wherein M is an alkali metal or ammonium ion; R is the residue of a polyol selected from the group consisting of pentaerythritol, dipentaerythritol, tripentaerythritol, sorbitol, sucrose, mannitol, and arabitol; and *n* is the number of hydroxyl groups of said polyol; the weight ratio of said detergent builder compound to said detergent-active compound being between about 10:1 and about 1:10.

2. A detergent composition defined in claim 1, wherein M is a sodium ion.

3. A detergent composition defined in claim 2, wherein said polyol is tripentaerythritol.

* * * * *

UNITED STATES PATENT AND TRADEMARK OFFICE

CERTIFICATE OF CORRECTION

PATENT NO. : 4,021,359

DATED : May 3, 1977

INVENTOR(S) : FREDERICK C. SCHWAB

It is certified that error appears in the above-identified patent and that said Letters Patent are hereby corrected as shown below:

| | |
|---|---|
| Column 3, line 31 | "dialyl" should be --dialkyl-- |
| Column 3, line 32 | "to general" should be --to the general-- |
| Column 3, line 50 | "an an anionic" should be --an anionic-- |
| Column 4, line 27 | "sterification" should be --esterification |
| Column 8, line 36 | "without departing from the spirit and scope of this invention" is repeated |

Signed and Sealed this

*Thirteenth* Day of *September 197*

[SEAL]

*Attest:*

RUTH C. MASON
*Attesting Officer*

LUTRELLE F. PARKER
*Acting Commissioner of Patents and Trademark*